US006059673A

United States Patent [19]

Mason

[11] Patent Number: 6,059,673

[45] Date of Patent: May 9, 2000

[54] GOALIE TRAINING SYSTEM

[76] Inventor: Donald D. Mason, 18391 Gladstone Blvd., Maple Grove, Minn. 55311

[21] Appl. No.: 09/300,097

[22] Filed: Apr. 27, 1999

[51] Int. Cl.[7] ..... A63B 69/00

[52] U.S. Cl. ..... 473/478; 473/415; 473/471; 473/446

[58] Field of Search ..... 473/422, 167, 473/471, 588, 415, 490, 446; 472/88, 90–92; 463/2; 62/235, 320, 602; 249/69

[56] References Cited

U.S. PATENT DOCUMENTS

| | | | |
|---|---|---|---|
| 1,818,749 | 8/1931 | Pittler | 473/167 |
| 3,858,887 | 1/1975 | Wallin | 473/167 |
| 4,192,511 | 3/1980 | Fitzgerald | 473/167 |
| 4,497,483 | 2/1985 | Ahlgren | 473/446 |
| 4,607,842 | 8/1986 | Daoust | 473/446 |
| 5,509,652 | 4/1996 | Woronets | 473/446 |
| 5,584,481 | 12/1996 | Caluori et al. | 473/446 |
| 5,771,706 | 7/1998 | Lavigne | 472/92 |
| 5,820,470 | 10/1998 | Saunders | 472/90 |
| 5,882,204 | 3/1999 | Iannazo et al. | 473/442 |
| 5,897,438 | 4/1999 | Kunz et al. | 472/90 |
| 5,906,545 | 5/1999 | Eden et al. | 472/92 |

*Primary Examiner*—Jeanette Chapman
*Assistant Examiner*—Mitra Aryanpour

[57] ABSTRACT

A goalie training system for providing a realistic training system that accommodates a goalie and a plurality of shooters at different angles. The inventive device includes a goalie zone and a plurality of shooting lanes extending from the goalie zone at various angles. The goalie zone is comprised of a center member, a pair of side members adjacent the center member, a center surface above the center member, and a pair of side surfaces above the side members. The center surface, the side surfaces and the lane surface are comprised of a synthetic ice material that allows conventional ice skates to be utilized. The plurality of shooting lanes are comprised of at least one lane member and at least one lane surface positioned above the lane member. A goal is positioned behind the goalie zone for simulating a realistic hockey rink. At least one shooter is able to utilize the shooting lane for shooting pucks at the goal which the goalie attempts to deflect within the goalie zone.

6 Claims, 5 Drawing Sheets

GOALIE TRAINING SYSTEM

BACKGROUND OF THE INVENTION

1. Field of the Invention

The present invention relates generally to hockey surfaces and more specifically it relates to a goalie training system for providing a realistic training system that accommodates a goalie and a plurality of shooters at different angles.

Training a goalie can be difficult if an ice-rink is unavailable. Conventional methods of training a goalie include utilizing roller blades with a ball utilized upon a hard surface. This has limited effectiveness for training a goalie because the conditions are not that similar to ice conditions. Therefore, there is a need for a system that simulates ice and that supports a goalie and at least one shooter.

2. Description of the Prior Art

Synthetic hockey surfaces have been in use for years. Typically, a synthetic hockey surface includes a plurality of rectangular synthetic platforms either welded together or attached by some rigid attachment means. A common problem with these systems is buckling due to expansion during temperature changes. In addition, constructing an entire arena of synthetic platforms is extremely expensive and cost prohibitive for most hockey programs.

While these devices may be suitable for the particular purpose to which they address, they are not as suitable for providing a realistic training system that accommodates a goalie and a plurality of shooters at different angles. Conventional synthetic ice systems are expensive and difficult to maintain. In addition they are generally permanent and cannot be disassembled and reassembled in a different location.

In these respects, the goalie training system according to the present invention substantially departs from the conventional concepts and designs of the prior art, and in so doing provides an apparatus primarily developed for the purpose of providing a realistic training system that accommodates a goalie and a plurality of shooters at different angles. The goalie training system allows for expansion and contraction of its synthetic surface while keeping it stabilized at the same time. This is truly a unique and novel approach and complete departure from any other connection process for synthetic skating surfaces.

SUMMARY OF THE INVENTION

In view of the foregoing disadvantages inherent in the known types of synthetic ice systems now present in the prior art, the present invention provides a new goalie training system construction wherein the same can be utilized for providing a realistic training system that accommodates a goalie and a plurality of shooters at different angles.

The general purpose of the present invention, which will be described subsequently in greater detail, is to provide a new goalie training system that has many of the advantages of the synthetic ice systems mentioned heretofore and many novel features that result in a new goalie training system which is not anticipated, rendered obvious, suggested, or even implied by any of the prior art synthetic ice systems, either alone or in any combination thereof.

To attain this, the present invention generally comprises a goalie zone and a plurality of shooting lanes extending from the goalie zone at various angles. The goalie zone is comprised of a center member, a pair of side members adjacent the center member, a center surface above the center member, and a pair of side surfaces above the side members.

The center surface, the side surfaces and the lane surface are comprised of a synthetic ice material that allows conventional ice skates to be utilized. The plurality of shooting lanes are comprised of at least one lane member and at least one lane surface positioned above the lane member. A goal is positioned behind the goalie zone for simulating a realistic hockey rink. At least one shooter is able to utilize the shooting lane for shooting pucks at the goal which the goalie attempts to deflect within the goalie zone.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a goalie training system that will overcome the shortcomings of the prior art devices.

Another object is to provide a goalie training system that accommodates a goalie and a plurality of shooters at different angles.

An additional object is to provide a goalie training system that can be stored within a compact space.

A further object is to provide a goalie training system that can be disassembled and reassembled in a different location.

Another object is to provide a goalie training system that allows a shooter to attack the goalie at different angles.

Another object is to provide a goalie training system that will allow another skater to be on the crease area with the goalie to do screening type drills with the assistance of shooters from the shooting lanes.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIGS. 2*a*, 2*b*, 2*c*, 2*d*, 2*e*, 2*f*, 2*g*, 2*h*, 2*i*, 2*j*, 2*k*, 2*l* are magnified views of FIG. 2.

FIGS. 5*a*, 5*b*, 5*c* are magnified views of FIG. 5.

DESCRIPTION OF THE PREFERRED EMBODIMENT

Figure 1:
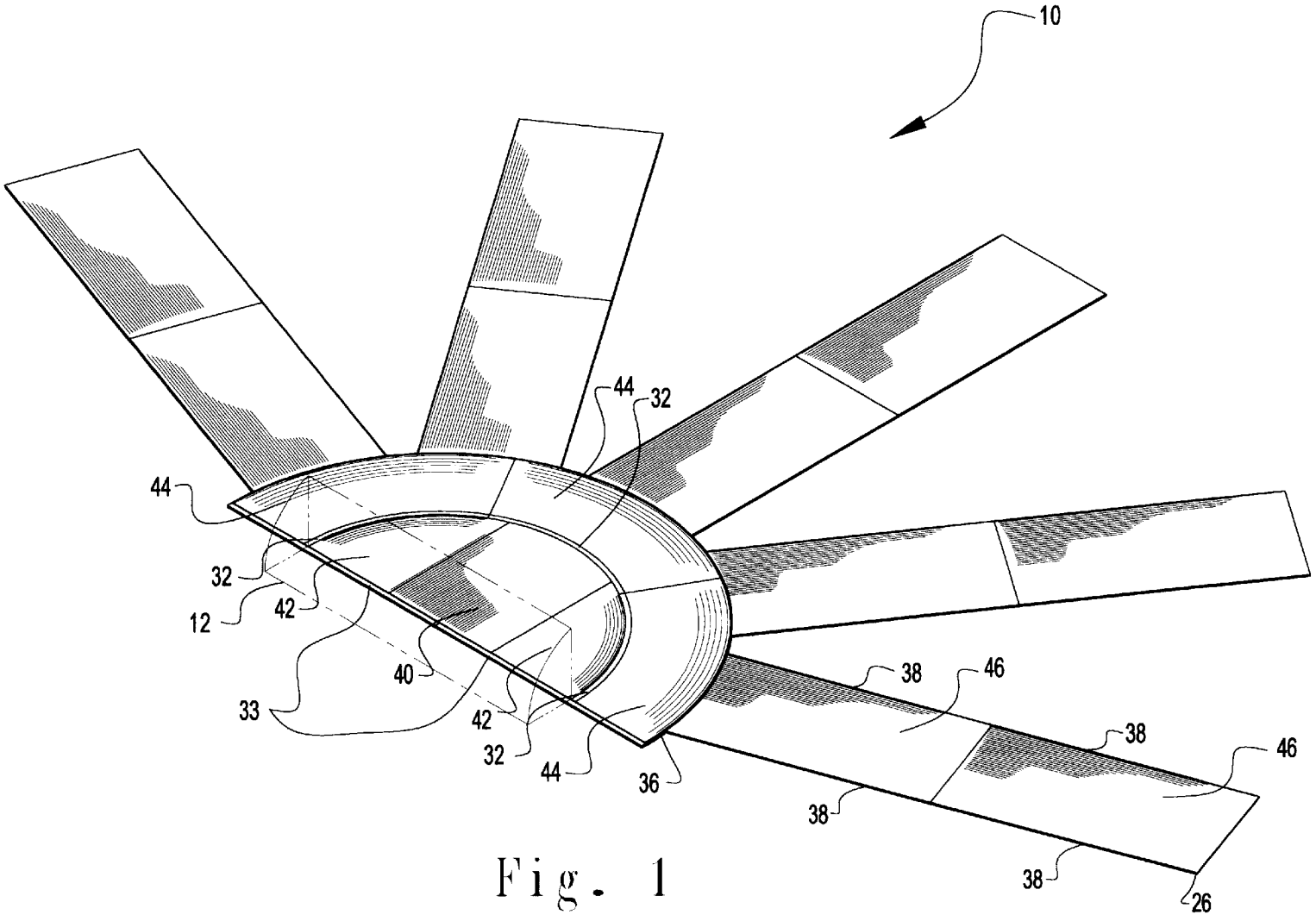
FIG. 1 is an upper perspective view of the present invention.

Turning now descriptively to the drawings, in which similar reference characters denote similar elements throughout the several view, FIGS. 1 through 5 illustrate a goalie training system 10, which comprises a goalie zone and a plurality of shooting lanes extending from the goalie zone at various angles. The goalie zone is comprised of a center member 20, a pair of side members 22 adjacent the center member 20, a center surface 40 above the center member 20, and a pair of side surfaces 42 above the side members 22. The center surface 40, the side surfaces 42 and the lane surface 46 are comprised of a synthetic ice material that allows conventional ice skates to be utilized. The plurality of shooting lanes are comprised of at least one lane member 24 and at least one lane surface 46 positioned above the lane member 24. A goal 12 is positioned behind the goalie zone for simulating a realistic hockey rink. At least one shooter is able to utilize the shooting lane for shooting pucks at the goal 12 which the goalie attempts to deflect within the goalie zone.

Figure 2:
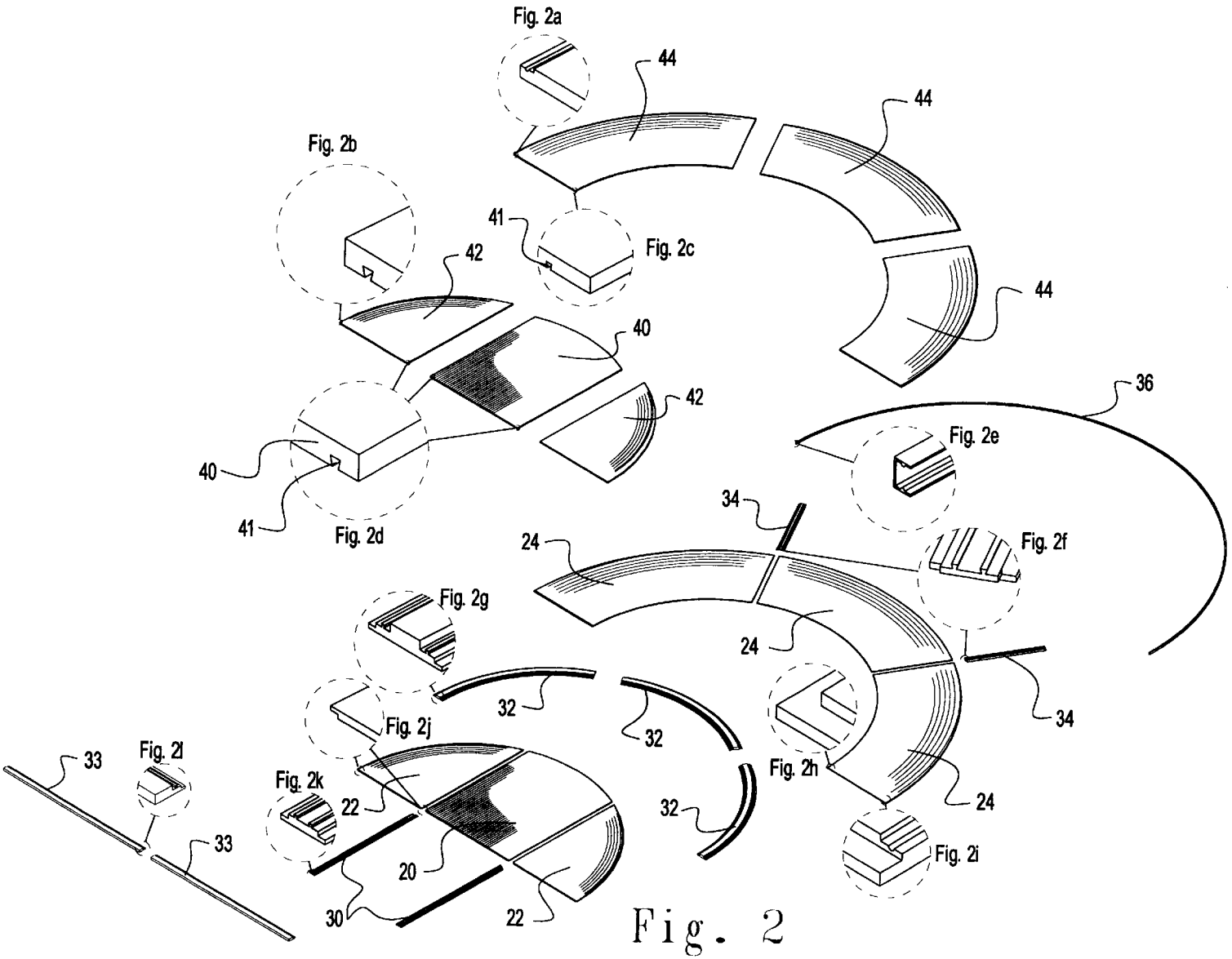
FIG. 2 is an exploded upper perspective view of the present invention.

As best shown in FIG. 2 of the drawings, the pair of side members 22 are removably attached to the center member 20 by a pair of first connection bars 30. A crease member is attached about the arcuate perimeter edge of the center member 20 and the side members 22.

The crease member is comprised of synthetic ice material and is colored to represent the crease line in front of a goal 12. A pair of rear connection bars 33 are attached to the rear edge of the center member 20 and the pair of side members 22 as shown in FIG. 2 of the drawings.

As further shown FIG. 2 of the drawings, three outer members 24 are attached about the crease member. The outer members 24 are connected to one another by a pair of second connection bars 34 as shown in FIG. 2 of the drawings. The outer members 24, the center member 20 and the pair of side members 22 are preferably constructed of a rigid material such as plywood. The center member 20, the pair of side members 22 and the outer members 24 form a semi-circular shape.

Figure 3:
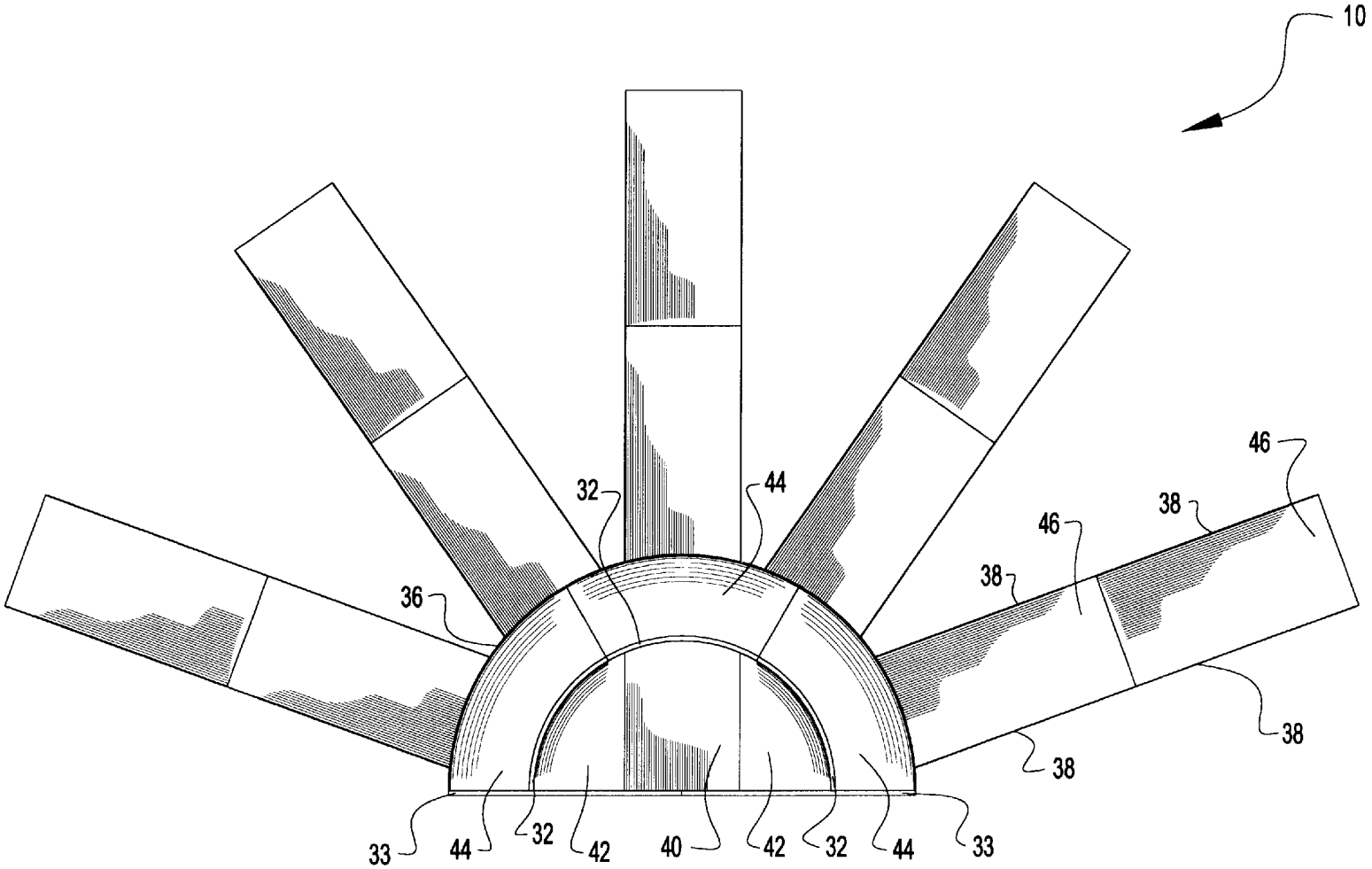
FIG. 3 is a top view of the present invention.
Figure 4:
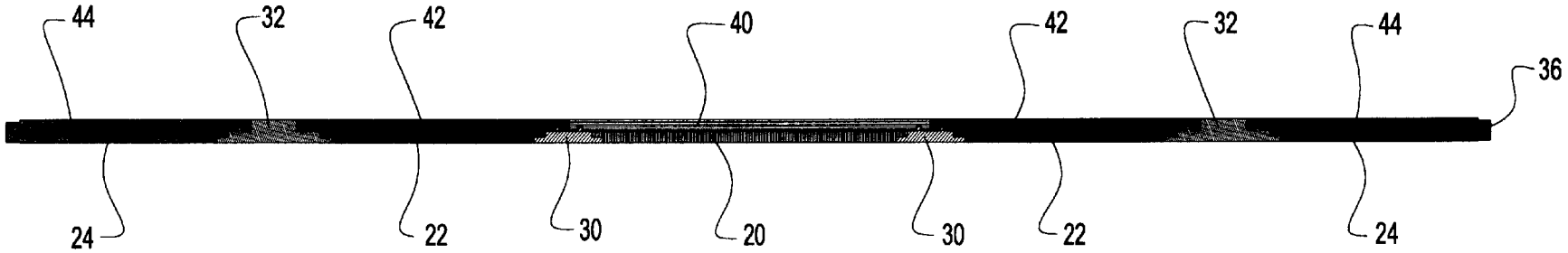
FIG. 4 is a cross sectional view taken along line 4—4 of FIG. 1.

As shown in FIGS. 1 through 3 of the drawings, a center surface 40 and a pair of side surfaces 42 are positioned above the center member 20 and side members 22 respectively. The adjacent edges of the center surface 40 and the side surfaces 42 have a surface rabbet 41 for engaging the pair of first connection bars 30.

As shown in FIGS. 1 through 3 of the drawings, the outer surfaces 44 include a surface rabbet 41 within the interior edge for connecting with the crease members 32. An elongated and curved connection clamp 36 is attachable about the outer perimeter of the outer members 24 and outer surfaces 44.

The center surface 40, side surfaces 42 and outer surfaces 44 are comprised of a synthetic ice material that allows a goalie to skate upon. A goal 12 is positioned adjacent the center surface 40 and side surfaces 42 as shown in FIG. 1 of the drawings for simulating a hockey rink.

Figure 5:
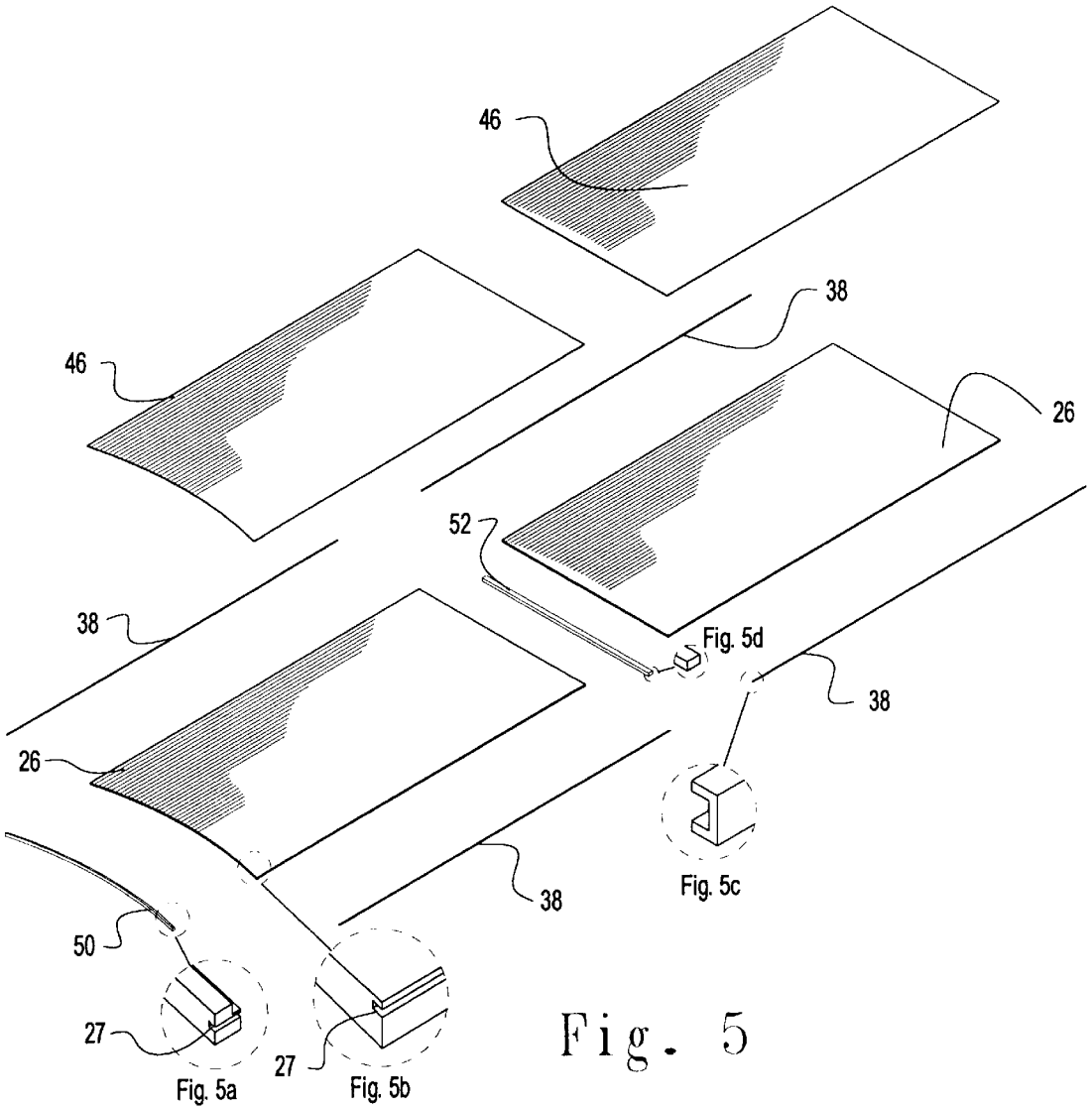
FIG. 5 is an exploded upper perspective view of the shooting lane.

As shown in FIG. 5 of the drawings, at least one lane member 24 is provided. A curved bridge member 50 is connected to the inner curved edge of the lane member 24 that is positionable adjacent the connection clamp 36. If more than one lane member 24 is utilized, they are aligned longitudinally with one another thereby forming a shooting lane with a third connection bar 52 positioned between them.

As shown in FIG. 5 of the drawings, a lane rabbet 27 extends into the opposing longitudinal sides of each lane member 24. A plurality of shooting lanes are desirable that are positioned at different angles within respect to the goalie zone for increasing the realism of the play of hockey.

As shown in FIG. 5 of the drawings, a lane surface 46 is provided for each lane member 24 utilized and are positioned juxtaposed to the lane member 24. A plurality of lane clamps 38 are connectable within the lane rabbet 27 of each lane member 24 and to each lane surface 46 thereby retaining the lane surface 46 to the lane member 24.

In use, the inventive device is assembled in a desirable location to practice hockey. The goalie and the shooter or shooters wear conventional ice skates and utilize a conventional hockey puck. The goalie is initially positioned within the crease member as with an actual hockey rink and the shooters are positioned upon the shooting lanes. The shooters utilize conventional hockey pucks and skate down the shooting lanes toward the goalie thereafter shooting their respective hockey puck toward the goal 12 in an attempt to position the hockey puck within the goal 12 while the goalie attempts to prevent the hockey puck from entering the goal 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A goalie training system, comprising:

a hockey goal;

a goalie zone constructed of synthetic ice, wherein said goalie zone has a semi-circular shape and allows positioning of said hockey goal behind said goalie zone; and a plurality of shooting lanes having a synthetic ice surface aligned with said goalie zone, wherein said plurality of shooting lanes are attached at various angles with respect to said goalie zone.

2. A goalie training system, comprising:

a goalie base having a semi-circular shape;

a goalie surface attachable to said goalie base, wherein said goalie surface has a semi-circular shape similar to said goalie base;

at least one lane base having a synthetic ice surface positionable with respect to said goalie base; and at least one lane surface attachable to said at least one lane base wherein said goalie base is comprised of:

a center member;

a pair of side members connected to said center member by a pair of first connection bars; and a plurality of outer members connected to an outer perimeter of said center member and said pair of side members by a crease member, wherein said crease member simultaneously represents a crease line;

wherein said plurality of outer members are connected by a second connection bar between each of said plurality of outer members.

3. The goalie training system of claim 2, wherein said goalie surface comprises:

a center surface connectable between said pair of first connection bars;

a pair of side surfaces connected to said pair of first connection bars opposite of said center surface; and a plurality of outer surfaces positionable above said outer members.

4. The goalie training system of claim 3, wherein said outer surfaces and said outer members are retained together by a connection clamp.

5. The goalie training system of claim 4, wherein said at least one lane base is comprised of:

at least one lane member having a lane rabbet within the opposing longitudinal edges;

a bridge member connectable to a front edge of said at least one lane member; and a plurality of lane clamps attached within said lane rabbets and to said lane surface.

6. The goalie training system of claim 5, wherein said at least one lane surface and said goalie surface are comprised of a synthetic ice material.

* * * * *